US005171653A

United States Patent [19]

Jugle et al.

[11] Patent Number: 5,171,653

[45] Date of Patent: Dec. 15, 1992

[54] ELECTROSTATIC DEVELOPING COMPOSITION WITH CARRIER HAVING EXTERNAL ADDITIVE

[75] Inventors: Don B. Jugle, Penfield; Michael L. Grande, Palmyra; Edward J. Gutman; Douglas A. Lundy, both of Webster; Charles D. Zimmer, Ontario, all of N.Y.

[73] Assignee: Xerox Corporation, Stamford, Conn.

[21] Appl. No.: 755,915

[22] Filed: Sep. 6, 1991

[51] Int. Cl.[5] ..... G03G 9/097; G03G 9/10

[52] U.S. Cl. ..... 430/108; 430/110

[58] Field of Search ..... 430/108, 110

[56] References Cited

U.S. PATENT DOCUMENTS

| | | | |
|---|---|---|---|
| 4,073,980 | 2/1978 | Westdale et al. | 428/404 |
| 4,078,929 | 3/1978 | Gundlach . | |
| 4,331,756 | 5/1982 | Mayer et al. | 430/108 |
| 4,614,165 | 9/1986 | Folkins et al. | 118/657 |
| 4,686,163 | 8/1987 | Ng et al. | 430/47 |
| 4,847,176 | 7/1989 | Sano et al. | 430/106.6 |
| 4,920,023 | 4/1990 | Koch et al. | 430/126 |
| 4,921,771 | 5/1990 | Tomono et al. | 430/110 |
| 4,948,686 | 8/1990 | Koch et al. | 430/45 |
| 4,960,665 | 10/1990 | Elder et al. | 430/110 |

FOREIGN PATENT DOCUMENTS

| | | | |
|---|---|---|---|
| 9468 | 1/1989 | Japan | 430/108 |
| 9469 | 1/1989 | Japan | 430/108 |
| 9470 | 1/1989 | Japan | 430/108 |
| 1-80563 | 7/1989 | Japan | 430/108 |

*Primary Examiner*—Roland Martin

*Attorney, Agent, or Firm*—Judith L. Byorick

[57] ABSTRACT

Disclosed is a developer composition which consists essentially of a toner consisting essentially of a resin, a colorant, and colloidal silica external additive particles and a carrier consisting essentially of a core, an optional coating on the core, and an external additive selected from the group consisting of metal salts of fatty acids, linear polymeric alcohols comprising a fully saturated hydrocarbon backbone with at least about 80 percent of the polymeric chains terminated at one chain end with a hydroxyl group, polyethylene waxes with a molecular weight of from about 300 to about 2,000 polypropylene waxes with a molecular weight of from about 300 to about 3,000, and mixtures thereof. Also disclosed are processes for using the aforementioned developer in a tri-level development process.

13 Claims, No Drawings

ELECTROSTATIC DEVELOPING COMPOSITION WITH CARRIER HAVING EXTERNAL ADDITIVE

BACKGROUND OF THE INVENTION

The present invention is directed to a composition and a process for developing electrostatic latent images. More specifically, the present invention is directed to a developer composition (and a process for using said composition) which results in reduced image defects such as slipping of the developed image on the photoreceptor, blurred edges of solid area images, washed out fine lines, fuzzy halftones and the like. One embodiment of the present invention is directed to a developer composition which consists essentially of a toner consisting essentially of a resin, a colorant, a charge control agent, and colloidal silica external additive particles and a carrier consisting essentially of a core, an optional coating on the core, and an external additive selected from the group consisting of metal salts, metal salts of fatty acids, linear polymeric alcohols comprising a fully saturated hydrocarbon backbone with at least about 80 percent of the polymeric chains terminated at one chain end with a hydroxyl group, polyethylene waxes with a molecular weight of from about 300 to about 2,000, polypropylene waxes with a molecular weight of from about 300 to about 3,000, and mixtures thereof.

Developer compositions wherein the toner contains external additives such as silica particles or metal salts of fatty acids are known. For example, U.S. Pat. No. 4,948,686 (Koch et al.), the disclosure of which is totally incorporated herein by reference, discloses developers suitable for the formation of colored images wherein the toners contain colloidal silica external additives, fatty acid metal salt external additives, and in some instances external additives consisting of a linear polymeric alcohol comprising a fully saturated hydrocarbon backbone with at least about 80 percent of the polymeric chains terminated at one chain end with a hydroxyl group. The disclosed developers are suitable for the formation of two-colored images in a single development pass, wherein the imaging member is charged to three different levels of potential, the black toner is used to develop one level of potential, the colored toner is used to develop another level of potential, and the third level of potential remains undeveloped as background areas. Imaging processes of this type are also disclosed in, for example, U.S. Pat. No. 4,078,929, the disclosure of which is totally incorporated herein by reference. Also of interest with respect to the tri-level process for generating images is U.S. Pat. No. 4,686,163, the disclosure of which is totally incorporated herein by reference.

Typically, toners that contain colloidal silica and metal salts of fatty acids as external additives contain the silica to improve the flow properties of the toner particles, assure adequate triboelectric charging, enhance admix times (the time required for uncharged toner to become fully charged when mixed with a developer containing a carrier and a charged toner of the same composition as the uncharged toner), and improve temporal stability of the charging properties of the developer. The metal salts of fatty acids typically are added for the purpose of maintaining sufficient conductivity in the toner to assure development with a conductive "magnetic brush" development system.

One difficulty that can be encountered when employing developers wherein the toner contains both silica and a fatty acid metal salt as external additives is deposition of the fatty acid metal salt on the imaging member. Eventually, deposition of the fatty acid metal salt on the imaging member can cause the imaging member to become sufficiently slippery that the tangential forces of the flowing developer striking the developed image overcome the product of the force on the toner as a result of its charge and the electric field in which it resides and the coefficient of friction between the toner and the imaging member, resulting in irregular sliding of the image on the imaging member surface (an image defect sometimes referred to as "scoop" or "slip"). Subsequent to deposition of the fatty acid metal salt on the imaging member, the silica additive can become embedded in the fatty acid metal salt deposited on the imaging member. At high relative humidity, the silica thus deposited can absorb sufficient quantities of water to become conductive, resulting in lateral conductivity of the latent electrostatic image on the imaging member, causing copy quality defects such as blurry edges of solid area images, washed out fine lines, wider and lower density than expected lines, fuzzy half tones, and the like.

The developer and process of the present invention enables the reduction or elimination of this difficulty while retaining the advantages of external additives such as fatty acid metal salts and linear polymeric alcohols.

U.S. Pat. No. 4,073,980 (Westdale et al.) discloses carrier particles for use in an electrophotographic process which are prepared by applying a mixture of a perfluoro acid and molybdenum disulfide to the surface of the carrier particle. The resulting carriers have a very thin film deposited on the surface thereof and are long lived and abrasion resistant.

U.S. Pat. No. 4,331,756 (Mayer et al.), the disclosure of which is totally incorporated herein by reference, discloses electrophotographic developer compositions containing carrier, toner, and special purpose additives such as flow promoters, dry lubricants, and the like. The developers are prepared by coating carrier particles with a coating selected so that the triboelectric relationship between the surface of the carrier and the surface of the additive is substantially zero.

U.S. Pat. No. 4,847,176 (Sano et al.) discloses a binder type carrier comprising at least magnetic particles and a binder resin having an acid value of 50 mg KOH/g or less and a hydroxyl value of 50 mg KOH/g or less, in which a product of the acid value by the hydroxyl value is within the range of from 1 to 600, which gives a high specific volume resistance of equal to or more than $10^{13}$ ohm-cm and an excellent humidity resistance.

U.S. Pat. No. 4,921,771 (Tomono et al.) discloses a toner for developing electrostatic images which comprises a coloring agent, a styrene homopolymer or copolymer with a vinyl monomer or monomers, and polypropylene having a number average molecular weight of about 3000 to 4000 in an amount between about 0.02 and 40 parts by weight per 100 parts by weight of the styrene homopolymer or copolymer.

U.S. Pat. No. 4,920,023 (Koch et al.), the disclosure of which is totally incorporated herein by reference, discloses a process for the preparation of stable developer compositions which comprises treating coated carrier particles with metal salts or metal salts of fatty acids and thereafter admixing these particles with a colored toner composition containing metal salts or metal salts of fatty acids and comprising resin particles and colored pigment particles, wherein the salts are present in an amount of from about 0.01 to about 1 percent by weight.

U.S. Pat. No. 4,960,665 (Elder et al.), the disclosure of which is totally incorporated herein by reference, discloses a toner comprising resin particles, and a component with a sponge or non-flake like morphology selected from the group consisting of metal salts, metal salts of fatty acids, and mixtures thereof.

U.S. Pat. No. 4,614,165, the disclosure of which is totally incorporated herein by reference, discloses a process which comprises transporting a developer material comprising at least carrier granules and toner particles from a housing storing a supply thereof in a chamber to the surface of a photoconductive member having an electrostatic latent image recorded thereon, and discharging toner particles and carrier granules into the chamber of the housing with the carrier granules being added to the chamber of the housing so that the usable life of the developer material is at least equal to the usable life of the imaging machine containing the photoconductive member and with the ratio of toner particles to carrier granules by weight being supplied to the chamber of the housing being substantially greater than the ratio of toner particles to carrier granules by weight in the chamber of the housing.

While known compositions and processes are suitable for their intended purposes, a need remains for developer compositions that generate images of high quality. In addition, there is a need for developer compositions containing both silica external additives and fatty acid metal salt, linear alcohol, or wax external additives wherein deposition of the fatty acid metal salt, linear alcohol, or wax external additive on the imaging member is reduced. Further, a need exists for developer compositions with good flow properties, adequate triboelectric charging, rapid admix times, temporal stability, and adequate conductivity for conductive magnetic brush development processes. Additionally, there is a need for developer compositions that reduce slipping of the developed image on the imaging member. There is also a need for developer compositions that contain both silica external additives and fatty acid metal salt, linear alcohol, or wax external additives and that do not result in lateral conductivity of the latent image on the imaging member.

SUMMARY OF THE INVENTION

It is an object of the present invention to provide developer compositions that generate images of high quality.

It is another object of the present invention to provide developer compositions containing both silica external additives and fatty acid metal salt, linear alcohol, or wax external additives wherein deposition of the fatty acid metal salt, linear alcohol, or wax external additive on the imaging member is reduced.

It is yet another object of the present invention to provide developer compositions with good flow properties, adequate triboelectric charging, rapid admix times, temporal stability, and adequate conductivity for conductive magnetic brush development processes.

It is still another object of the present invention to provide developer compositions that reduce slipping of the developed image on the imaging member.

Another object of the present invention is to provide developer compositions that contain both silica external additives and fatty acid metal salt, linear alcohol, or wax external additives and that do not result in lateral conductivity of the latent image on the imaging member.

These and other objects of the present invention (or specific embodiments thereof) can be achieved by providing a developer composition which consists essentially of a toner consisting essentially of a resin, a colorant, a charge control agent, and colloidal silica external additive particles and a carrier consisting essentially of a core, an optional coating on the core, and an external additive selected from the group consisting of metal salts of fatty acids, linear polymeric alcohols comprising a fully saturated hydrocarbon backbone with at least about 80 percent of the polymeric chains terminated at one chain end with a hydroxyl group, polyethylene waxes with a molecular weight of from about 300 to about 2,000, polypropylene waxes with a molecular weight of from about 300 to about 3,000, and mixtures thereof. Another embodiment of the present invention is directed to a process for forming images with two different toners which comprises (1) charging an imaging member in an imaging apparatus; (2) creating on the member a latent image comprising areas of high, intermediate, and low potential; (3) developing the low areas of potential by conductive magnetic brush development with a first developer consisting essentially of a first toner consisting essentially of a first resin present in an amount of from about 80 to about 98.8 percent by weight and selected from the group consisting of polyesters, styrene-butadiene polymers, styrene-acrylate polymers, styrene-methacrylate polymers, and mixtures thereof; a first pigment present in an amount of from about 1 to about 15 percent by weight and selected from the group consisting of copper phthalocyanine pigments, quinacridone pigments, azo pigments, rhodamine pigments, magnetites, and mixtures thereof; a charge control agent present in an amount of from about 0.2 to about 5 percent by weight; and colloidal silica surface external additives present in an amount of from about 0.1 to about 2 percent by weight; and a first carrier consisting essentially of a steel core with an average diameter of from about 25 to about 215 microns and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier, said carrier having on the surface thereof external additives selected from the group consisting of metal salts of fatty acids, linear polymeric alcohols comprising a fully saturated hydrocarbon backbone with at least about 80 percent of the polymeric chains terminated at one chain end with a hydroxyl group, polyethylene waxes with a molecular weight of from about 300 to about 2,000, polypropylene waxes with a molecular weight of from about 300 to about 3,000, and mixtures thereof present in an amount of from about 0.1 to about 2 percent by weight; (4) subsequently developing the high areas of potential by conductive magnetic brush development with a second developer consisting essentially of a second toner consisting essentially of a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment, present in an amount of from about 1 to about 15 percent by weight; and a second charge control additive present in an amount of from about 0.1 to about 6 percent by weight; and a second carrier consisting essentially of a steel core with an average diameter of from about 25 to about 215 microns and a coating selected from the group consisting of chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed image to a substrate.

The developers of the present invention generally consist essentially of a toner and a carrier. The toner generally consists essentially of a resin, a colorant, and a charge control agent as well as a silica external additive. Suitable resins include polyesters and styrene-butadiene polymers, particularly styrene-butadiene copolymers wherein the styrene portion is present in an amount of from about 83 to about 93 percent by weight, preferably about 88 percent by weight, and the butadiene portion is present in an amount of from about 7 to about 17 percent by weight, preferably about 12 percent by weight, such as the resins commercially available as Pliolite® or Pliotone® from Goodyear. Also suitable are styrene acrylate polymers and styrene-methacrylate polymers, particularly those styrene-n-butylmethacrylate copolymers wherein the styrene portion is present in an amount of from about 50 to about 80 percent by weight, preferably about 58 percent by weight, and the n-butylmethacrylate portion is present in an amount of from about 20 to about 50 percent by weight, preferably about 42 percent by weight. Mixtures of these resins are also suitable. Also particularly suitable for inclusion in the toners for the present invention are styrene-n-butylmethacrylate polymers wherein the styrene portionis present in an amount of from about 50 to about 80 percent by weight, preferably about 65 percent by weight, and the n-butylmethacrylate portion is present in an amount of from about 50 to about 20 percent by weight, preferably about 35 percent by weight. The resin is present in the toner in an effective amount, typically from about 65 to about 98.8 percent by weight.

The colorant typically is a pigment or mixture of pigments, although dyes can also be used. Suitable toner pigments include carbon black, including Regal 330®, commercially available from Cabot Corporation, copper phthalocyanine pigments, quinacridone pigments, azo pigments, rhodamine pigments, magnetites, and mixtures thereof. Specific examples include Fanal Pink, commercially available from BASF, Sudan Blue OS, commercially available from BASF, Neopan Blue, commercially available from BASF, PV Fast Blue, commercially available from BASF, Lithol Scarlet, commercially available from BASF, Hostaperm Pink E pigment, commercially available from American Hoechst Company, Fanchon Fast Red R-6226, commercially available from Mobay Chemical Company, Permanent Yellow FGL, commercially available from E. I. DuPont, and Mapico Black, commercially available from Columbian Chemical Company. The pigment is present in the toner in an effective amount, typically from about 1 to about 40 percent by weight, and preferably from about 2 to about 10 percent by weight.

Suitable charge control agents for the toners include alkyl pyridinium halides such as cetyl pyridinium chloride, distearyl dimethyl ammonium methyl sulfate, and aluminum t-butyl salicylic acid. The charge control agent is present in the toner in an effective amount, typically from about 0.1 to about 6, and preferably from about 0.5 to about 2 percent by weight, although other amounts can be used. When the images formed are to be fused with rollers of Viton®, a distearyl dimethyl ammonium methyl sulfate charge control agent is preferred, since it is more compatible with Viton®. When other materials comprise the fuser roll, however, cetyl pyridinium chloride may also be used. The presence of these charge control additives generally also improve admix performance.

The toners also contain a colloidal silica external additive, such as Aerosil® R972, Aerosil® R976, Aerosil® R812, and the like, available from Degussa, or the Cab-o-sil series of silica available from Cabot, blended on the surface of the toner. Toners with external additives blended on the surface are disclosed in references such as U.S. Pat. Nos. 3,590,000, 3,720,617, 3,900,588, and 3,983,045, the disclosures of each of which are totally incorporated herein by reference. The silica is present in an effective amount, typically from about 0.1 to about 2 parts by weight per 100 parts by weight toner, and preferably about 0.3 parts by weight per 100 parts by weight toner.

The toners can be prepared by processes such as extrusion, which is a continuous process that entails dry blending the resin, pigment, and charge control additive, placing them into an extruder, melting and mixing the mixture, extruding the material, and reducing the extruded material to pellet form. The pellets are further reduced in size by grinding or jetting, and are then classified to the required particle size. External additives such as silica are then blended with the classified toner in a powder blender. Subsequent mixing of the toners with the carriers, generally in amounts of from about 0.5 to about 15 percent by weight of the toner and from about 85 to about 99.5 percent by weight of the carrier, and preferably in amounts of from about 2 to about 4 parts by weight toner per 100 parts by weight carrier, yields the developers of the present invention.

The toner particles and carrier particles can be mixed together in any effective amounts to form a replenisher. The ratio of toner to carrier may vary, however, provided that the objectives of the present invention are achieved. For example, an imaging apparatus employed for the process of the present invention may be replenished with a replenisher comprising about 75 percent by weight toner and about 25 percent by weight carrier.

Any suitable coated or uncoated carrier particles can be used. Preferred carriers are generally conductive, and generally exhibit a conductivity of, for example, from about $10^{-14}$ to about $10^{-6}$, and preferably from about $10^{-12}$ to about $10^{-7}$ (ohm-cm)$^{-1}$. Conductivity is generally controlled by the choice of carrier size, core shape, and coating weight; by partially coating the carrier core, or by coating the core with a coating of a material containing carbon black, the carrier is rendered conductive. In addition, irregularly shaped carrier particle surfaces and toner concentrations of from about 0.2 to about 5 will generally render a developer conductive. Addition of a surface additive such as zinc stearate to the surface of the carrier particles also renders a developer conductive, with the level of conductivity rising with increased concentrations of the additive. One suitable carrier for the developers of the present invention generally comprises a steel core, preferably unoxidized, such as Hoeganoes Anchor Steel Grit, with an average diameter of from about 25 to about 215 microns, preferably from 50 to 150 microns. The carrier particles can be coated with a solution coating of methyl terpolymer containing from 0 to about 40 percent by weight of conductive particles such as carbon black or other conductive particles as disclosed in U.S. Pat. No. 3,533,835, the disclosure of which is totally incorporated herein by reference, homogeneously dispersed in the coating material, with the coating weight being from about 0.2 to about 3 percent by weight of the carrier core, and preferably from about 0.4 to about 1.5 percent by weight of the carrier core. Alternatively, the carrier coating may comprise polymethylmethacrylate containing conductive particles such as carbon black or any other suitable conductive material in an amount of from 0 to about 40 percent by weight of the polymethylmethacrylate, and preferably from about 10 to about 20 percent by weight of the polymethylmethacrylate, wherein the coating weight is from about 0.2 to about 3 percent by weight of the carrier core and preferably about 1 percent by weight of the carrier core. A third possible carrier coating for the carrier of the first developer comprises a blend of from about 35 to about 65 percent by weight of polymethylmethacrylate and from about 35 to about 65 percent by weight of chlorotrifluoroethylene-vinyl chloride copolymer, commercially available as OXY 461 from Occidental Petroleum Company containing conductive particles in an amount of from 0 to about 40 percent by weight, and preferably from about 20 to about 30 percent by weight, wherein the coating weight is from about 0.2 to about 3 percent by weight of the carrier core, and preferably about 1 percent by weight of the carrier core. An additional suitable coating comprises chlorotrifluoroethylene-vinyl chloride copolymer, commercially available as OXY 461 from Occidental Petroleum Company, said coating containing from 0 to about 40 percent by weight of conductive particles homogenously dispersed in the coating, at a coating weight of from about 0.4 to about 1.5 percent by weight. This coating is generally solution coated onto the carrier core from a suitable solvent, such as methyl ethyl ketone or toluene. Alternatively, the carrier coating may comprise a coating of polyvinyl fluoride, commercially available as Tedlar ® from E. I. DuPont de Nemours and Company, present in a coating weight of from about 0.01 to about 0.2, and preferably about 0.05, percent by weight of the carrier core. The polyvinyl fluoride coating is generally coated onto the core by a powder coating process, wherein the carrier core is coated with the polyvinyl fluoride in powder form and subsequently heated to fuse the coating. In one preferred embodiment, the carrier comprises an unoxidized steel core which is blended with polyvinyl fluoride (Tedlar ®), wherein the polyvinyl fluoride is present in an amount of about 0.05 percent by weight of the core. This mixture is then heat treated in a kiln at about 400° F. to fuse the polyvinyl fluoride coating to the core. The resulting carrier exhibits a conductivity of about $7.6\times10^{-10}$(ohm-cm)$^{-1}$. Optionally, an additional coating of polyvinylidene fluoride, commercially available as Kynar ® from Pennwalt Corporation, may be powder coated on top of the other coating of the carrier in the developer at a coating weight of from about 0.01 to about 0.2 percent by weight of the carrier core. The carrier coatings can be placed on the carrier cores by solution coating processes or by dry coating processes. Coating of the carrier particles of the present invention may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved.

The carrier particles also contain external additives selected from the group consisting of metal salts of fatty acids, such as zinc stearate, magnesium stearate, aluminum stearate, cadmium stearate, and the like, linear polymeric alcohols comprising a fully saturated hydrocarbon backbone with at least about 80 percent of the polymeric chains terminated at one chain end with a hydroxyl group, polyethylene waxes with a molecular weight of from about 300 to about 2,000, polypropylene waxes with a molecular weight of from about 300 to about 3,000, and mixtures thereof. The linear polymeric alcohol is of the general formula $CH_3(CH_2)_nCH_2OH$, wherein n is a number from about 30 to about 300, and preferably from about 30 to about 50. Linear polymeric alcohols of this type are generally available from Petrolite Chemical Company as Unilin TM . The carrier external additive is present in any effective amount. Typically, the external additive is present in an amount of from 0.001 to about 2 parts by weight per 100 parts by weight carrier, and preferably from about 0.01 to about 1 parts by weight per 100 parts by weight carrier.

The carrier external additives are applied to the carrier surface by mechanically mixing the carrier with the additive until the additive has become impacted onto the carrier surface. The external additives remain on the carrier surface subsequent to the mechanical mixing. When the carrier particles with external additives on their surfaces have been mixed with toner particles to form a developer composition, the carrier external additives generally remain on the carrier surface and do not transfer to the toner surface; although extremely small amounts of the additive may eventually be worn off the carrier surface, any carrier external additives that do become transferred to the toner particles are transferred in extremely small amounts and in extremely small particle sizes, and do not result in adverse effects that might be observed if the toner were prepared with external additives similar to those on the carrier surface. It is believed that the carrier external additives function as a lubricant between the toner particles and the carrier particles, and although the additives may eventually be worn off the carrier in molecular quantities (i.e., particles amounting to about $10^1$ or $10^2$ molecules), the amount transferred is insufficient to result in image defects such as scoop or slip, which would result from an undesirable lubrication effect between the toner particles and the imaging member. Thus, the external additives on the carrier permit the toner to slide from the carrier under the influence of a magnetic field and enhance developer conductivity, but do not cause undesirable image defects.

Developers of the present invention are particularly suitable for use in tri-level imaging processes. Imaging members suitable for use with the process of the present invention may be of any type capable of maintaining three distinct levels of potential. Generally, various dielectric or photoconductive insulating material suitable for use in xerographic, ionographic, or other electrophotographic processes may be used, and suitable photoreceptor materials include amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may consist of either a positive or a negative potential, or both. In one embodiment, the image consists of three distinct levels of potential, all being of the same polarity. The levels of potential should be well differentiated, such that they are separated by at least 100 volts, and preferably 200 volts or more. For example, a latent image on an imaging member can consist of areas of potential at −800, −400, and −100 volts. In addition, the levels of potential may consist of ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range, with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ, depending upon the type of imaging member selected.

The latent image comprising three levels of potential, hereinafter referred to as a tri-level image, may be formed on the imaging member by any of various suitable methods, such as those disclosed in U.S. Pat. No. 4,078,929, the disclosure of which is totally incorporated herein by reference. For example, a tri-level charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a tri-level charge pattern may be formed by means of a raster output scanner, optically modulating laser light as it scans a uniformly charged photoconductive imaging member. In this embodiment, the areas of high potential are formed by turning the light source off, the areas of intermediate potential are formed by exposing the imaging member to the light source at partial power, and the areas of low potential are formed by exposing the imaging member to the light source at full power. Other electrophotographic and ionographic methods of generating latent images are also acceptable.

Preferably, in the process of the present invention the areas of the image to be developed with the first developer are developed first to minimize the interaction between the two developers, thereby maintaining the high quality of the image developed with the second developer, although the image to be developed with the second developer may, if desired, be developed first.

Development is generally by the magnetic brush development process disclosed in U.S. Pat. No. 2,874,063, the disclosure of which is totally incorporated herein by reference. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. For the process of the present invention, the conductive magnetic brush process is generally preferred, wherein the developer comprises conductive carrier particles and is capable of conducting an electric field between the biased magnet through the carrier particles to the photoreceptor. Conductive magnetic brush development is generally employed for the process of the present invention in view of the relatively small development potentials of around 200 volts that are generally available for the process; conductive development ensures that sufficient toner is laid on the photoreceptor under these development potentials to result in acceptable image density. Conductive development is also preferred to ensure that fringe fields occurring around the edges of images developed with one developer are not developed by the toner of the other developer.

During the development process, the developer housings are biased to a voltage between the level of potential being developed and the intermediate level of charge on the imaging member. For example, if the latent image consists of a high level of potential of about −800 volts, an intermediate level of potential of about −400 volts, and a low level of about −100 volts, the developer housing containing the positively charged toner that develops the high areas of potential may be biased to about −500 volts and the developer housing containing the negatively charged toner that develops the low areas of potential may be biased to about −300 volts. These biases result in a development potential of about −200 volts for the high areas of potential, which will be developed with a positively charged toner, and a development potential of about +200 volts for the low areas of potential, which will be developed with a negatively charged toner. Background deposits are suppressed by keeping the background intermediate voltage between the bias on the first developer housing and the bias on the second developer housing. Generally, it is preferred to bias the housing containing the positive toner to a voltage of from about 100 to about 150 volts above the intermediate level of potential and to bias the housing containing the negative toner to a voltage of from about 100 to about 150 volts below the intermediate level of potential, although these values may be outside these ranges provided that the objectives of the present invention are achieved.

Developers of the present invention are particularly suitable for use in a process known as "trickle development," wherein during the use of the imaging apparatus the toner added to the developer housing as a replenisher also contains carrier particles. This process results in the developer having a useful life at least equal to the usable life of the imaging apparatus. This development process is disclosed in U.S. Pat. No. 4,614,165, the disclosure of which is totally incorporated herein by reference. Specifically, the process entails transporting a developer material comprising at least carrier granules and toner particles from a housing storing a supply thereof in a chamber to the surface of a photoconductive member having an electrostatic latent image recorded thereon, and discharging toner particles and carrier granules into the chamber of the housing with the carrier granules being added to the chamber of the housing so that the usable life of the developer material is at least equal to the usable life of the imaging machine containing the photoconductive member and with the ratio of toner particles to carrier granules by weight being supplied to the chamber of the housing being substantially greater than the ratio of toner particles to carrier granules by weight in the chamber of the housing. In a preferred embodiment, the step of discharging includes the step of adding carrier granules to the chamber of the housing as a function of the rate of aging of the carrier material in the chamber of the housing and the required charging ability of the toner particles in the chamber of the housing to ensure that the usable life of the developer material in the chamber of the housing is at least equal to the life of the imaging machine. In one embodiment, the toner particles and the carrier particles are stored in separate containers and then mixing them so they intermingle; in another embodiment, the toner particles and carrier particles are stored in a single container. In yet another embodiment, the fresh carrier particles added to the developer are of a composition different from that of the original carrier particles.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

The fatty acid metal salt, linear alcohol, or wax external additive can be attached to the carrier particles by mechanically agitating the carrier and the additive together. Attaching the external additive to the carrier particles enables the additive to perform the function of allowing the toner particles to slip off of the carrier particles when the developer is placed in a magnetic field, thus increasing the conductivity of the developer by allowing the conductive asperites on the carrier particles to touch one another. Once the external additive is attached to the carrier particles, it will have sufficient durability to enable the developer to perform adequately for the specified lifetime of the developer. In addition, a developer wherein the fatty acid metal salt, linear alcohol, or wax external additive is attached to the carrier will result in reduced deposition of the external additive on the imaging member because the toner particles on the carrier particles will minimize direct contact between the external additive and the imaging member, thereby eliminating copy quality defects associated with a film of external additives on the imaging member.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A red toner composition was prepared as follows. 85 parts by weight of styrene butadiene, 1 part by weight of distearyl dimethyl ammonium methyl sulfate, available from Hexcel Corporation, 13.44 parts by weight of a 1:1 blend of styrene-n-butylmethacrylate and Lithol Scarlet NB3755 from BASF, and 0.56 parts by weight of Hostaperm Pink E from Hoechst Corporation were melt blended in an extruder wherein the die was maintained at a temperature of between 130° and 145° C. and the barrel temperature ranged from about 80° to about 100° C., followed by micronization and air classification to yield toner particles of a size of 11.5 microns in volume average diameter. The toner particles were then blended with 0.3 parts by weight of Aerosil ® R972 and 0.3 parts by weight of zinc stearate onto the surface of the toner in a Lodige blender.

A carrier composition was prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate. The carrier was coated by a solution coating process from a methyl ethyl ketone solvent and the dry coating was present in an amount of 1.0 part by weight coating per 100 parts by weight core.

Subsequently, 100 parts by weight of the carrier and 3 parts by weight of the toner were introduced into a Lodige high intensity blender and blended together at 200 revolutions per minute for 20 minutes. The resulting red developer contained negatively charged toner particles resulting red developer contained negatively charged toner particles.

The developer thus prepared was incorporated into an imaging test fixture containing a new photoreceptor and new cleaning brush, and a positively charged latent image was generated on the imaging member and developed. The process was repeated a number of times. After 750 prints had been generated, the fine lines on the print exhibited evidence of image scoop or slip. This test was repeated several times, and the onset of the image scoop defect occurred each time between 450 to 1,000 prints. Specifically, the fine lines of the image were diminished or disappeared entirely, and solid areas were diminished by as much as ⅛ inch on each edge; it is believed that this image defect occurred as a result of buildup of the zinc stearate toner additive on the imaging member surface, resulting in a reduced coefficient of friction between the toner and the imaging member which caused the toner to slide off the imaging member.

EXAMPLE II

A red toner composition was prepared as follows. 85 parts by weight of styrene butadiene, 1 part by weight of distearyl dimethyl ammonium methyl sulfate, available from Hexcel Corporation, 13.44 parts by weight of a 1:1 blend of styrene-n-butylmethacrylate and Lithol Scarlet NB3755 from BASF, and 0.56 parts by weight of Hostaperm Pink E from Hoechst Corporation were melt blended in an extruder wherein the die was maintained at a temperature of between 130° and 145° C. and the barrel temperature ranged from about 80° to about 100° C., followed by micronization and air classification to yield toner particles of a size of 11.5 microns in volume average diameter. The toner particles were then blended with 0.3 parts by weight of Aerosil® R972 onto the surface of the toner in a Lodige blender. This toner contained no zinc stearate external additive.

A carrier composition was prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate. The carrier was coated by a solution coating process from a methyl ethyl ketone solvent and the dry coating was present in an amount of 1.0 part by weight coating per 100 parts by weight core. This carrier was then introduced into a Lodige high intensity blender in relative amounts of 100 parts by weight carrier and 0.04 parts by weight zinc stearate. The carrier and zinc stearate were blended together at 415 revolutions per minute for 20 minutes.

Subsequently, 100 parts by weight of the carrier and 3 parts by weight of the toner were introduced into the blender and blended together at 200 revolutions per minute for 20 minutes. The resulting red developer contained negatively charged toner particles.

The developer thus prepared was incorporated into the imaging test fixture of Example I containing a new photoreceptor and new cleaning brush, and a positively charged latent image was generated on the imaging member and developed. The process was repeated several times. After 10,000 prints had been generated, the fine lines and solid areas on the prints exhibited no evidence of image scoop or slip.

EXAMPLE III

A red toner composition was prepared as follows. 85 parts by weight of styrene butadiene, 1 part by weight of distearyl dimethyl ammonium methyl sulfate, available from Hexcel Corporation, 13.44 parts by weight of a 1:1 blend of styrene-n-butylmethacrylate and Lithol Scarlet NB3755 from BASF, and 0.56 parts by weight of Hostaperm Pink E from Hoechst Corporation were melt blended in an extruder wherein the die was maintained at a temperature of between 130° and 145° C. and the barrel temperature ranged from about 80° to about 100° C., followed by micronization and air classification to yield toner particles of a size of 11.5 microns in volume average diameter. The toner particles were then blended with 0.3 parts by weight of Aerosil® R972 onto the surface of the toner in a Lodige blender. This toner contained no zinc stearate external additive.

A carrier composition was prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate. The carrier was coated by a solution coating process from a methyl ethyl ketone solvent and the dry coating was present in an amount of 1.0 part by weight coating per 100 parts by weight core. This carrier was then introduced into a Lodige high intensity blender in relative amounts of 100 parts by weight carrier and 0.04 parts by weight Unilin 700, a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is from about 30 to about 300, obtained from Petrolite Chemical Company. The carrier and linear polymeric alcohol were blended together at 415 revolutions per minute for 20 minutes.

Subsequently, 100 parts by weight of the carrier and 3 parts by weight of the toner were introduced into the blender and blended together at 200 revolutions per minute for 20 minutes. The resulting red developer contained negatively charged toner particles.

The developer thus prepared was incorporated into the imaging test fixture of Example I containing a new photoreceptor and new cleaning brush, and a positively charged latent image was generated on the imaging member and developed. The process was repeated a number of times. After 9,000 prints had been generated, the fine lines on the prints exhibited no evidence of image scoop or slip.

EXAMPLE IV

A blue toner composition is prepared as follows. 92 parts by weight of styrene butadiene, 1 part by weight of distearyl dimethyl ammonium methyl sulfate, available from Hexcel Corporation, and 7 parts by weight of PV Fast Blue from BASF are melt blended in an extruder wherein the die is maintained at a temperature of between 130° and 145° C. and the barrel temperature ranges from about 80° to about 100° C., followed by micronization and air classification to yield toner particles of a size of 12 microns in volume average diameter. The toner particles are then blended with 0.3 parts by weight of Aerosil® R972 onto the surface of the toner in a Lodige blender. This toner contains no zinc stearate external additive.

A carrier composition is prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate. The carrier is coated by a solution coating process from a toluene solvent and the dry coating is present in an amount of 1.0 part by weight coating per 100 parts by weight core. This carrier is then introduced into a Lodige high intensity blender in relative amounts of 100 parts by weight carrier and about 0.08 parts by weight Polywax 665, a polyethylene wax with a molecular weight of about 500 to about 1500, available from Petrolite Corporation. The carrier and polyethylene wax are blended together at 415 revolutions per minute for 20 minutes.

Subsequently, 100 parts by weight of the carrier and 3 parts by weight of the toner are introduced into the blender and blended together at 200 revolutions per minute for 20 minutes. The resulting blue developer contains negatively charged toner particles.

The developer thus prepared is incorporated into the imaging test fixture of Example I containing a new photoreceptor and new cleaning brush, and a positively charged latent image is generated on the imaging member and developed. It is believed that the fine lines on the prints thus prepared will exhibit no evidence of image scoop or slip, even after over 1,000 prints have been generated.

EXAMPLE V

A green developer is prepared as follows. 89.5 parts by weight of styrene butadiene, 0.5 part by weight of distearyl dimethyl ammonium methyl sulfate, available from Hexcel Corporation, 5 parts by weight of Sudan Blue from BASF, and 5 parts by weight of Permanent FGL Yellow from E.I. DuPont de Nemours and Company are melt blended in an extruder wherein the die is maintained at a temperature of between 130° and 145° C. and the barrel temperature ranges from about 80° to about 100° C., followed by micronization and air classification to yield toner particles of a size of 12.5 microns in volume average diameter. The toner particles are then blended with 0.3 part by weight of Aerosil ® R972 onto the surface of the toner in a Lodige blender. This toner contains no zinc stearate external additive.

A carrier composition is prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate. The carrier is coated by a solution coating process from a toluene solvent and the dry coating is present in an amount of 1.0 part by weight coating per 100 parts by weight core. This carrier is then introduced into a Lodige high intensity blender in relative amounts of 100 parts by weight carrier and 0.02 parts by weight 660P, a polypropylene wax with a molecular weight of about 2,000 to about 3,000, available from Sanyo Corporation. The carrier and polypropylene wax are blended together at 415 revolutions per minute for 20 minutes.

Subsequently, 100 parts by weight of the carrier and 3 parts by weight of the toner are introduced into the blender and blended together at 200 revolutions per minute for 20 minutes. The resulting green developer contains negatively charged toner particles.

The developer thus prepared is incorporated into the imaging test fixture of Example I containing a new photoreceptor and new cleaning brush, and a positively charged latent image is generated on the imaging member and developed. It is believed that the fine lines on the prints thus prepared will exhibit no evidence of image scoop or slip, even after over 1,000 prints have been generated.

EXAMPLE VI

A black developer composition is prepared as follows. 92 parts by weight of a styrene-n-butylmethacrylate resin, 6 parts by weight of Regal 330 ® carbon black from Cabot Corporation, and 2 parts by weight of cetyl pyridinium chloride are melt blended in an extruder wherein the die is maintained at a temperature of between 130° and 145° C. and the barrel temperature ranges from about 80° to about 100° C., followed by micronization and air classification to yield toner particles of a size of 12 microns in volume average diameter. Subsequently, carrier particles are prepared by solution coating a Hoeganoes Anchor Steel core with a particle diameter range of from about 75 to about 150 microns, available from Hoeganoes Company, with 0.4 parts by weight of a coating comprising 20 parts by weight of Vulcan carbon black, available from Cabot Corporation, homogeneously dispersed in 80 parts by weight of a chlorotrifluoroethylene-vinyl chloride copolymer, commercially available as OXY 461 from Occidental Petroleum Company, which coating is solution coated from a methyl ethyl ketone solvent. The black developer is then prepared by blending 97.5 parts by weight of the coated carrier particles with 2.5 parts by weight of the toner in a Lodige Blender for about 10 minutes, resulting in a developer with a toner exhibiting a positive triboelectric charge.

The black developer thus prepared and the red developer prepared in Example I are then incorporated into an imaging device equipped to generate and develop tri-level images according to the method of U.S. Pat. No. 4,078,929, the disclosure of which is totally incorporated herein by reference. A tri-level latent image is formed on the imaging member and the low areas of −100 volts potential are developed with the red developer, followed by development of the high areas of −750 volts potential with the black developer, subsequent transfer of the two-color image to paper, and heat fusing of the image to the paper. It is believed that images thus formed will exhibit image slip and scoop in the red areas by the time that 1,000 prints have been generated.

EXAMPLE VII

The process of Example VI is repeated four times by substituting the red developers prepared in Examples II and III, the blue developer prepared in Example IV, and the green developer prepared in Example V for the red developer prepared in Example I. It is believed that the images thus generated will be of excellent quality, with no image slip or scoop in the color image areas (red, blue, or green) even after 1,000 prints have been generated.

Other embodiments and modifications of the present invention may occur to those skilled in the art subsequent to a review of the information presented herein; these embodiments and modifications, as well as equivalents thereof, are also included within the scope of this invention.

What is claimed is:

1. A developer composition which consists essentially of a toner consisting essentially of a resin, a colorant, a charge control agent, and colloidal silica external additive particles and a carrier consisting essentially of a core, an optional coating on the core, and an external additive selected from the group consisting of metal salts of fatty acids, linear polymeric alcohols comprising a fully saturated hydrocarbon backbone with at least about 80 percent of the polymeric chains terminated at one chain end with a hydroxyl group, polyethylene waxes with a molecular weight of from about 300 to about 2,000, polypropylene waxes with a molecular weight of from about 300 to about 3,000, and mixtures thereof.

2. A developer composition according to claim 1 wherein the external additive on the carrier is present in an amount of from about 0.001 to about 2 parts by weight per 100 parts by weight of the carrier.

3. A developer composition according to claim 1 wherein the external additive on the carrier is present in an amount of from about 0.01 to about 1 parts by weight per 100 parts by weight of the carrier.

4. A developer composition according to claim 1 wherein the external additive on the carrier is zinc stearate.

5. A developer composition which consists essentially of a toner consisting essentially of a resin, a colorant, a charge control agent, and colloidal silica external additive particles and a carrier consisting essentially of a core, an optional coating on the core, and an external additive on the carrier which is a linear polymeric alcohol of the formula $CH_3(CH_2)_nCH_2OH$ wherein n is a number from about 30 to about 300.

6. A developer composition which consists essentially of a toner consisting essentially of a resin, a colorant, a charge control agent, and colloidal silica external additive particles and a carrier consisting essentially of a core, an optional coating on the core, and an external additive on the carrier which is a polyethylene wax with a molecular weight of from about 300 to about 2,000.

7. A developer composition which consists essentially of a toner consisting essentially of a resin, a colorant, a charge control agent, and colloidal silica external additive particles and a carrier consisting essentially of a core, an optional coating on the core, and an external additive on the carrier which is a polypropylene wax with a molecular weight of from about 300 to about 3,000.

8. A developer composition which consists essentially of a toner consisting essentially of a resin, a colorant, a charge control agent, and colloidal silica external additive particles and a carrier consisting essentially of a core, an optional coating on the core, and an external additive selected from the group consisting of linear polymeric alcohols comprising a fully saturated hydrocarbon backbone with at least about 80 percent of the polymeric chains terminated at one chain end with a hydroxyl group, polyethylene waxes with a molecular weight of from about 300 to about 2,000, polypropylene waxes with a molecular weight of from about 300 to about 3,000, and mixtures thereof.

9. A developer composition according to claim 8 wherein the external additive on the carrier is present in an amount of from about 0.001 to about 2 parts by weight per 100 parts by weight of the carrier.

10. A developer composition according to claim 8 wherein the external additive on the carrier is present in an amount of from about 0.01 to about 1 parts by weight per 100 parts by weight of the carrier.

11. A developer composition according to claim 8 also containing a metal salt of a fatty acid as an external additive on the carrier.

12. A developer composition according to claim 11 wherein the external additive on the carrier is present in an amount of from about 0.001 to about 2 parts by weight per 100 parts by weight of the carrier.

13. A developer composition according to claim 11 wherein the external additive on the carrier is present in an amount of from about 0.01 to about 1 parts by weight per 100 parts by weight of the carrier.

* * * * *